US006926270B2

(12) United States Patent
Caunter et al.

(10) Patent No.: US 6,926,270 B2
(45) Date of Patent: Aug. 9, 2005

(54) ROTARY BLADE DEVICE FOR PRINTED PRODUCTS

(75) Inventors: Nicholas J. Caunter, Portsmouth, NH (US); Richard D. Wamsley, Dover, NH (US); Kevin Krieg, Mason, OH (US)

(73) Assignee: Goss International Americas, Inc., Dover, NH (US)

( * ) Notice: Subject to any disclaimer, the term of this patent is extended or adjusted under 35 U.S.C. 154(b) by 0 days.

(21) Appl. No.: 10/910,667

(22) Filed: Aug. 3, 2004

(65) Prior Publication Data

US 2005/0005789 A1 Jan. 13, 2005

Related U.S. Application Data

(62) Division of application No. 10/154,563, filed on May 24, 2002, now Pat. No. 6,789,793.

(51) Int. Cl.[7] ..... B42B 2/00; B65H 29/54

(52) U.S. Cl. ..... 271/175; 271/278; 270/49; 270/50; 270/52.66; 270/52.04; 270/52.92; 270/3

(58) Field of Search ..... 271/175, 278; 270/49, 50, 52.66, 52.04

(56) References Cited

U.S. PATENT DOCUMENTS

| | | | | |
|---|---|---|---|---|
| 4,482,141 | A | 11/1984 | Moser | 270/54 |
| 5,272,946 | A * | 12/1993 | McCullough et al. | 83/58 |
| 5,595,119 | A | 1/1997 | Hada et al. | 101/477 |
| 6,547,510 | B1 * | 4/2003 | Beaulieu | 414/744.5 |
| 2001/0032774 | A1 | 10/2001 | Aesch | 198/644 |
| 2003/0217656 | A1 * | 11/2003 | Caunter et al. | 101/228 |
| 2004/0131461 | A1 * | 7/2004 | Momoki | 414/744.5 |

FOREIGN PATENT DOCUMENTS

| | | |
|---|---|---|
| EP | 0771675 | 5/1997 |

* cited by examiner

*Primary Examiner*—Andrew H. Hirshfeld
*Assistant Examiner*—Marvin P. Crenshaw
(74) *Attorney, Agent, or Firm*—Davidson, Davidson & Kappel, LLC

(57) ABSTRACT

A rotary blade device for interacting with printed materials has a rotating arm, a first pulley rotatably supported on the rotating arm, a first blade fixed to the first pulley, a fixed pulley, and a first belt connecting the first pulley to the fixed pulley so that as the arm rotates, the first pulley rotates with respect to the arm.

19 Claims, 5 Drawing Sheets

ROTARY BLADE DEVICE FOR PRINTED PRODUCTS

CROSS-REFERENCE TO RELATED APPLICATIONS

This is a divisional of U.S. patent application Ser. No. 10/154,563, filed on May 24, 2002, now U.S. Pat. No. 6,789,793, which is herby incorporated by reference herein.

BACKGROUND OF THE INVENTION

The present invention relates generally to printing presses and more particularly to a signature transport device for transporting printed products.

A web printing press, for example for newspapers, will print a continuous web of material. In a folder of the printing press, the web will be folded, if desired, and then cut, so that signatures result. The signatures can then be conveyed on a conveyor and delivered for further processing, such as collation.

U.S. Pat. No. 4,482,141 discloses a method and device for conveying signatures from a blade chain conveyor supporting the signatures directly at a fold line. The signatures are gripped from above by orbitally-rotating clamping pads, which then transfer the signatures to a belt conveyor perpendicular to the blade chain conveyor.

European Patent Application No. 0771 675 A1 discloses a device for removing signatures from a saddle conveyor supporting the signatures. The conveyor has cutouts that permit the signatures to be gripped from above by a rotating clamping device, which then further conveys the signatures to a belt conveyor.

U.S. Patent Application No. 2001/00327741 discloses a device for removing signatures from a saddle conveyor that moves the signatures over cutouts in a sword. Grippers grip the outside of the signature from above and transfer the signatures to a further conveying device.

SUMMARY OF THE INVENTION

An object of the present invention is to permit efficient removal of signatures from a saddle conveyor.

The present invention provides a signature transport device comprising: a conveyor for moving a plurality of signatures in a first direction, and a rotary blade device having a first blade having an edge for lifting a first signature of the plurality of signatures from the conveyor, the edge being parallel to the first direction, and the first blade rotating about an axis perpendicular to the edge.

By permitting the blade to rotate while the edge remains parallel to the first direction, the edge can lift the signatures from the conveyor.

Preferably, the rotary blade device includes a second blade rotating about the axis. The first and second blades may be supported rotatably on a rotating arm rotating about the axis.

The arm preferably includes a first pulley rotatably supported on one end of the arm, the first pulley fixed to the first blade. A belt then is connected to a fixed pulley. As the arm rotates, the belt interacts with the fixed pulley to cause the first pulley to rotate so that the edge remains in a same orientation, i.e. parallel to the first direction. The second blade may also be fixed to a second pulley, which is rotatably supported on another end of the arm. More than two blades may also be provided.

Preferably, the belts are toothed on an interior surface, and the pulleys on an outer surface. The belts may have a smooth outer surface. An adjustment roller interacting with the outer surface may set the tension in the belt.

The conveyor preferably includes two parallel chains, and the first blade passes between the two chains to contact a fold of the signatures.

The present invention also provides a printing press comprising a print unit for printing a material, a conveyor for moving a plurality of signatures formed from the material in a first direction, and a rotary blade device having a first blade having an edge for lifting a first signature of the plurality of signatures from the conveyor, the edge being parallel to the first direction, and the first blade rotating about an axis perpendicular to the edge.

Preferably, the printing press is a web printing press, and further includes a folder for forming signatures from the web.

The present invention also provides a rotary blade device for interacting with printed materials comprising a rotating arm, a first pulley rotatably supported on the rotating arm, a first blade fixed to the first pulley, a fixed pulley and a belt connecting the first pulley to the fixed pulley so that as the arm rotates, the first pulley rotates with respect to the arm.

Preferably, the rotary blade device includes a second blade and a second pulley attached to the arm.

BRIEF DESCRIPTION OF THE DRAWINGS

The following figures show a preferred embodiment of the present invention in which.

DETAILED DESCRIPTION OF A PREFERRED EMBODIMENT

Figure 1:
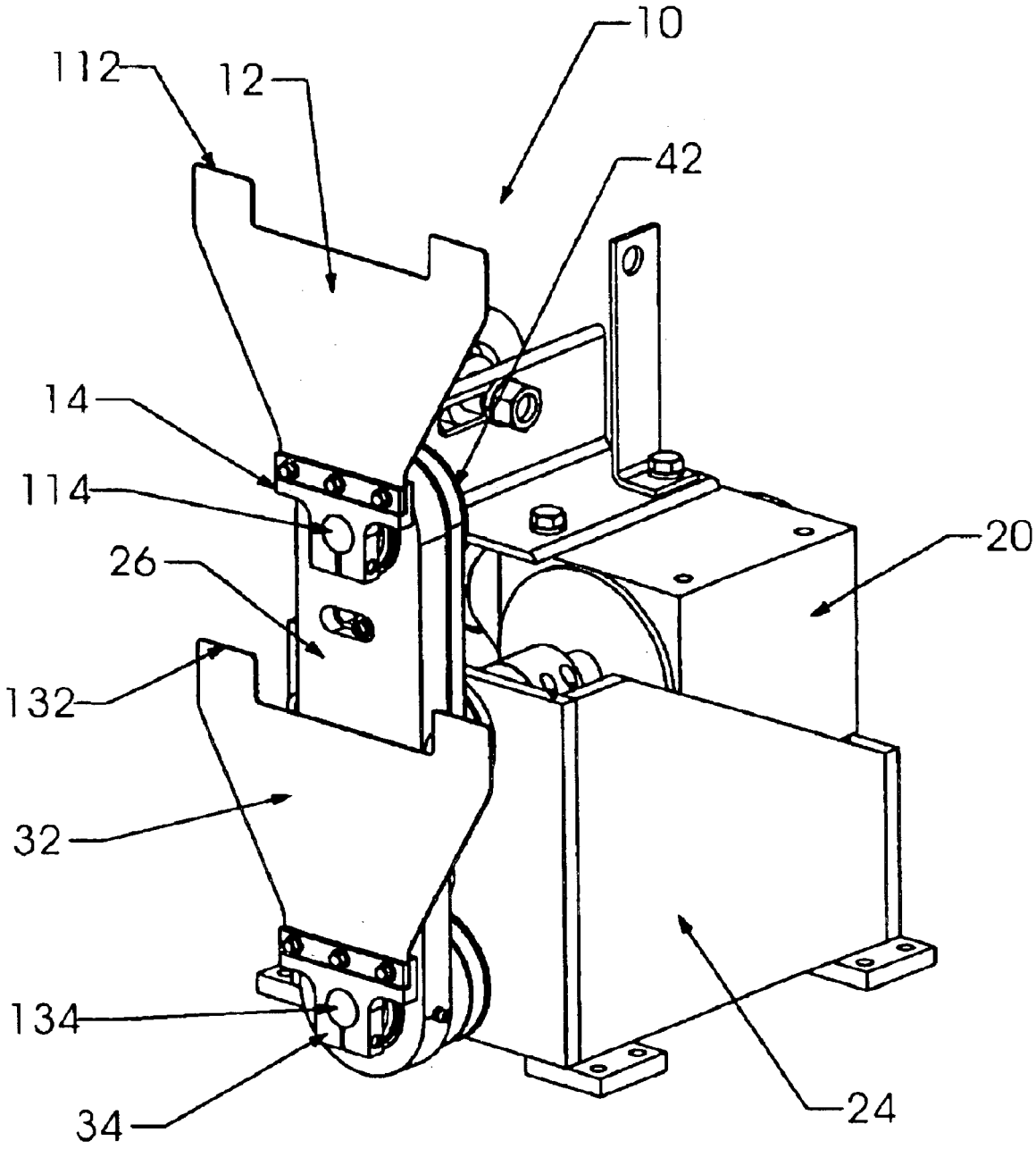
FIG. 1 shows a perspective view of a preferred exemplary embodiment of the rotary blade device of the present invention.

FIGS. 1 to 4 show views of a preferred exemplary embodiment of a rotary blade device 10. A gearbox 20 is housed in a stationary base 24. An arm 26 is rotated via a central shaft 60, shown in FIG. 4, driven by the gearbox 20.

Figure 3:
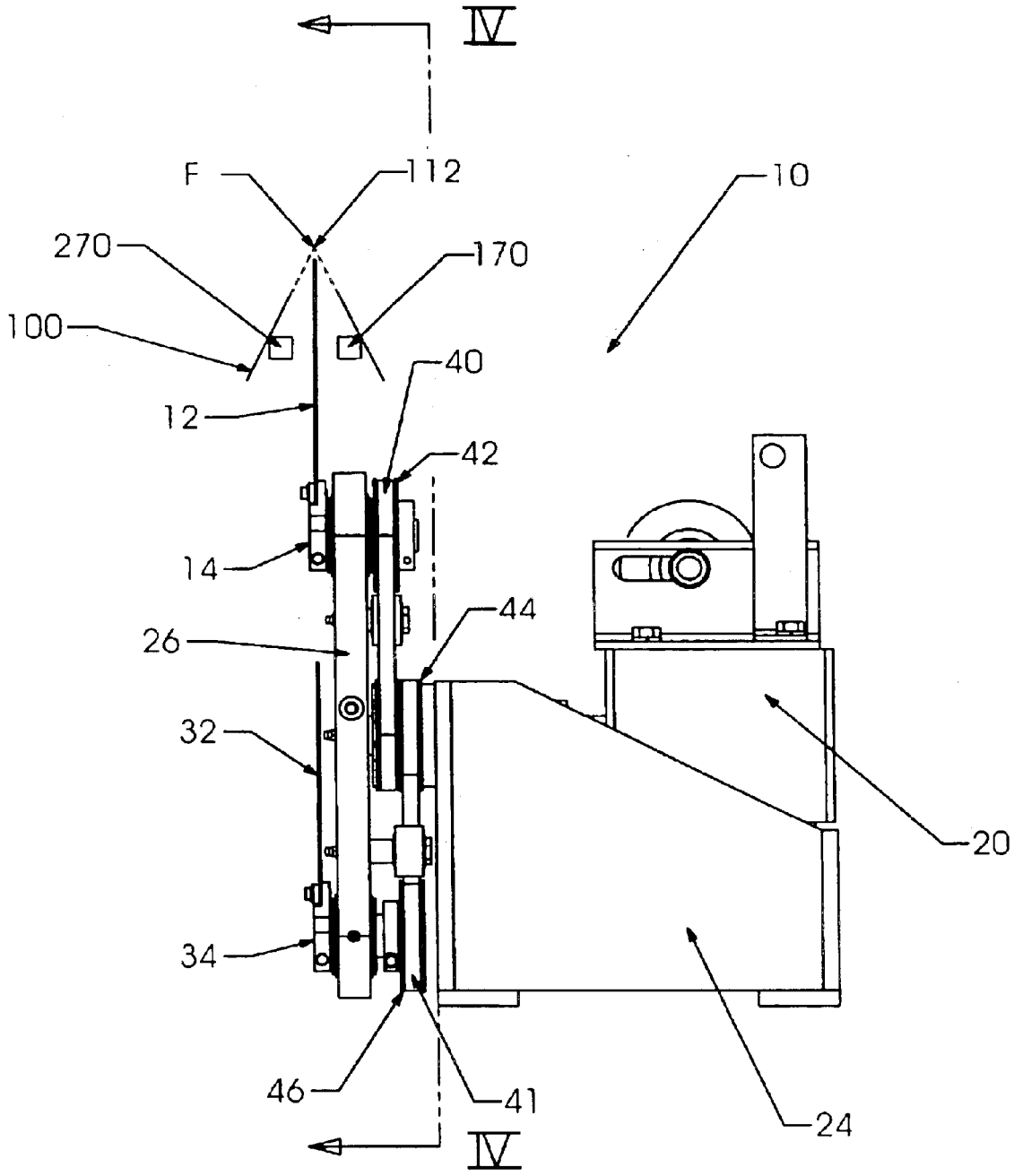
FIG. 3 shows a side view of the FIG. 1 embodiment.

As shown in FIGS. 1 and 3, on one end of arm 26, a pulley 42 is rotatably supported on arm 26, for example via a bearing. A shaft 114 is fixed to pulley 42. Shaft 114 is bearingly housed in arm 26 and extends through arm 26. A first blade 12 is fixed to a shaft 114 via a clamp 14. First blade 12, shaft 114 and pulley 42 thus are connected so as to rotate together, and all can rotate with respect to arm 26.

Figure 2:
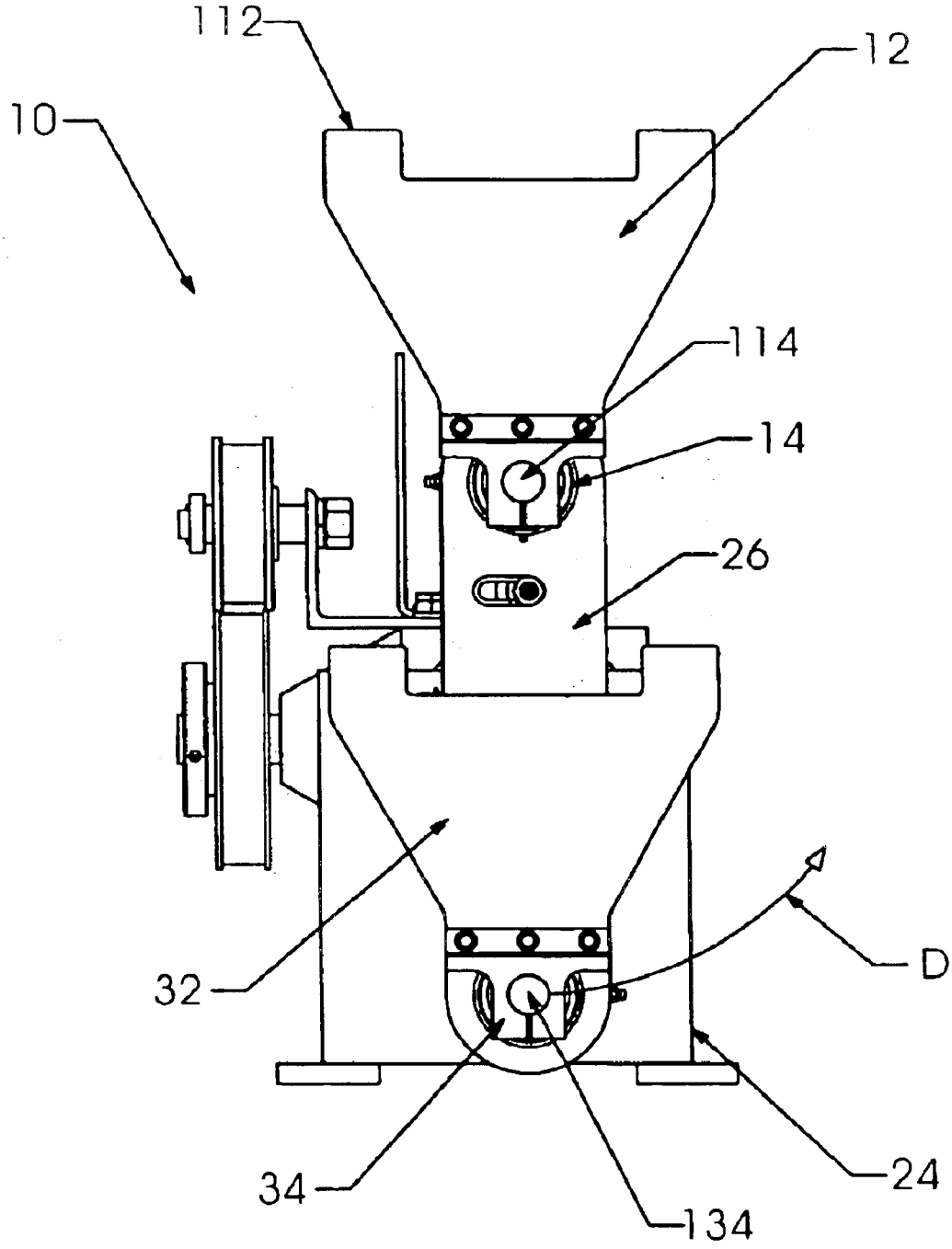
FIG. 2 shows a front view of the embodiment of FIG. 1.
Figure 4:
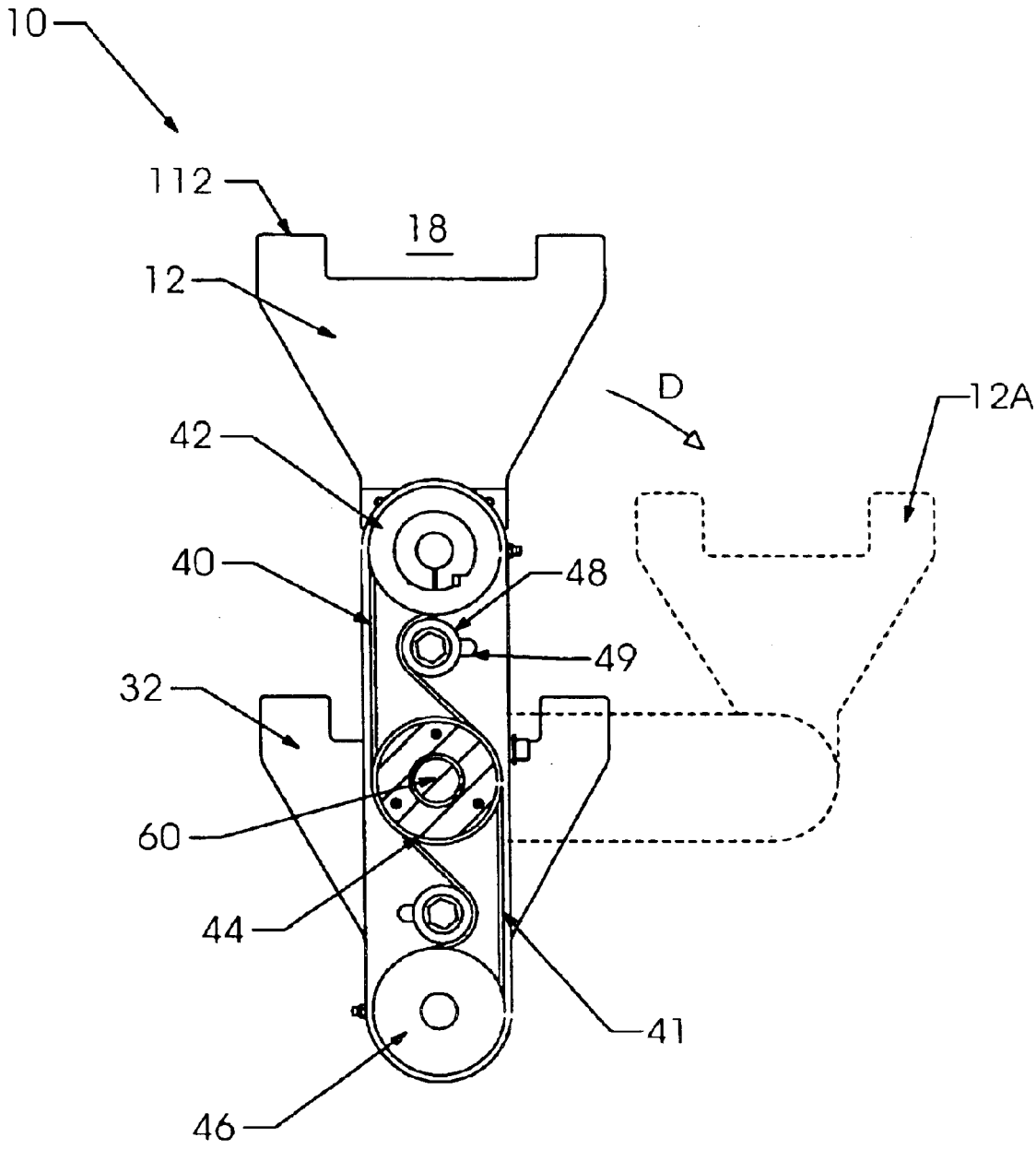
FIG. 4 shows a view of the embodiment of FIG. 1 through section A—A shown in FIG. 3, as well as showing in dotted lines a further position of one of the blades.

As shown in FIG. 4, central shaft 60 passes through, and can rotate with respect to, a fixed pulley 44 fixed to base 24. An interiorly-toothed belt 40 passes over fixed pulley 44 and pulley 42, both of which have external teeth. As shaft 60 rotates arm 26 in direction D, as shown in FIGS. 2 and 4, belt 40 rotates pulley 42. Blade 12 is this rotated with respect to arm 26 so that an edge 112 of blade 12 remains in a same orientation as shown by dashed lines for blade 12A in FIG. 4, for example horizontal in the embodiment shown. The axis of rotation is of shaft 60, and thus the blades, is perpendicular to the blade edge 112.

In order to control a tension on belt 40, an adjustment roller 48 can be slid against a smooth outer surface of belt 40. Adjustment roller 48 can move in slot 49 in arm 26 and be connected rotatably to arm 26.

Fixed pulley 44 has two toothed sections, one interacting with belt 40, and another interacting with a second toothed belt 41, which is connected to a second pulley 46 connected at another end of arm 26. Pulley 46 is fixed to a shaft 134 which supports a clamp 134 and second blade 32, as shown in FIG. 1. Second blade 32 thus is rotatably connected to the arm 26 in a similar manner as blade 12 is connected to arm 26, so that edge 132 remains in a similar orientation as arm 26 rotates.

Figure 5:
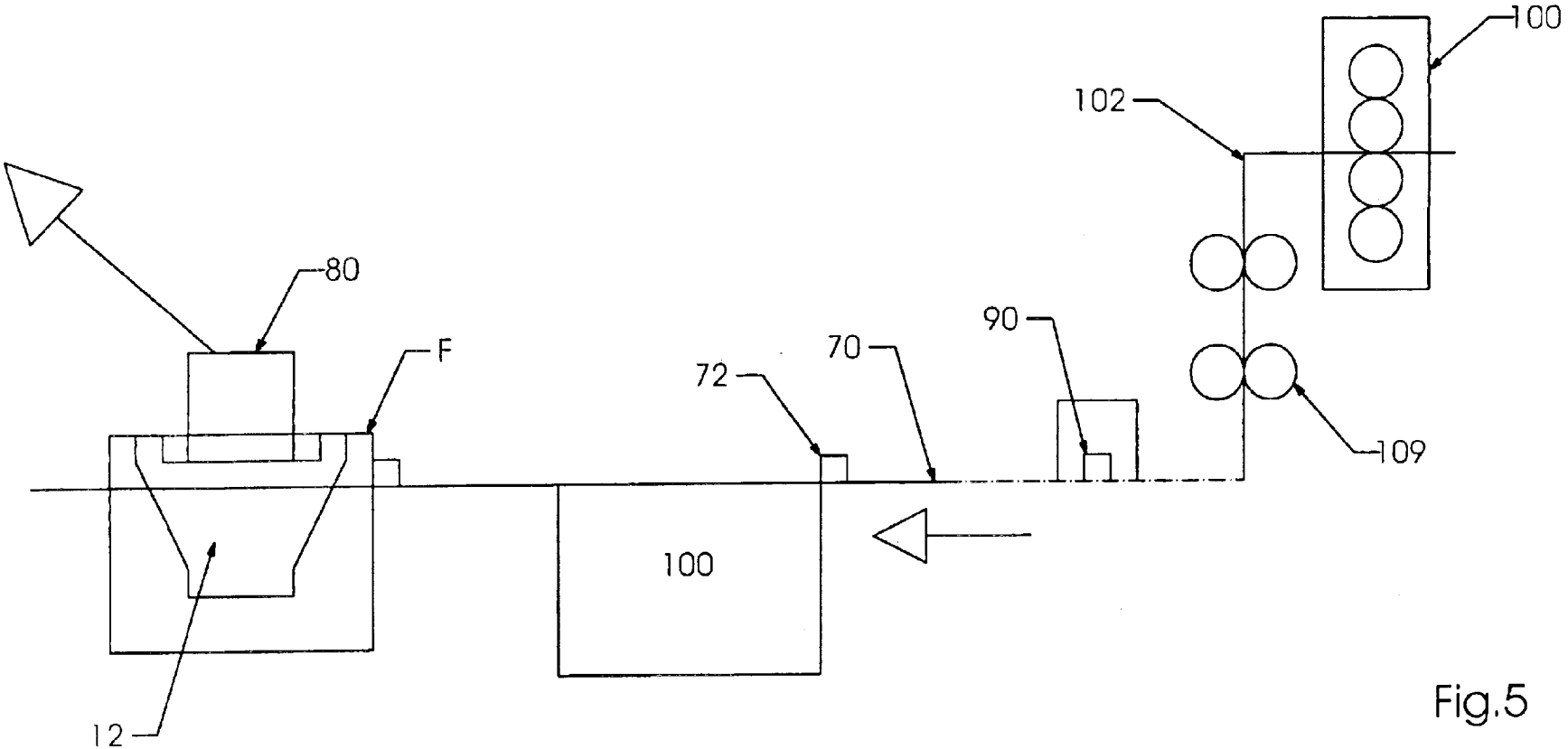
FIG. 5 shows a printing press according to the present invention having a saddle conveyor and rotary blade device as in FIG. 1.

As shown schematically in FIG. 5, in an exemplary offset lithographic web printing press 100 of the present invention a web 102 is printed and folded in a folder 104. The web is cut in folder 104 into signatures 100 that pass to a saddle conveyor 70. A stitcher 90 can stitch the fold F of the signature 100. As shown in FIG. 3, conveyor 70 has two chains 170, 270 on which signatures 100 travel, for example by being contacted by pushers 72.

Thus, as blade 12 rises and passes through chains 170, 270, blade edge 112 lifts signature 100 from chains 170, 270 by contacting a fold F of signature 100. The signature 100, held on blade 12, may accelerate in the direction of conveyor travel, so that pusher 72 no longer contacts signature 100. A second gripper conveyor 80 then may grip the signature 100 at an outer surface to further transport the signature. A cutout 18 in blade 12, as shown in FIG. 4, may be provided so that gripper conveyor 80 does not grip blade 12.

More than two blades are also possible by replacing two-legged arm 26 with a three or more-legged arm. "Signature" as defined herein can include single sheet or multi-sheet printed product. "Arm" as defined herein is any rotating support structure.

What is claimed is:

1. A rotary blade device for interacting with printed materials comprising:

a rotating arm, a first pulley rotatably supported on the rotating arm, a first blade fixed to the first pulley and arranged vertically to support a sheet of printed material, a fixed pulley, and a first belt connecting the first pulley to the fixed pulley so that as the arm rotates, the first pulley rotates with respect to the arm, wherein the first blade remains vertically oriented during rotation of the arm and the first pulley.

2. The rotary blade device as recited in claim 1 further comprising a second blade and a second pulley rotatably supported on the rotating arm.

3. The rotary blade device as recited in claim 2 further comprising a second belt and wherein the second pulley is connected to the fixed pulley via the second belt.

4. The rotary blade device as recited in claim 3 wherein the fixed pulley includes a first section and a second section coaxial with the first section, the first section contacting the first belt and the second section contacting the second belt.

5. The rotary blade device as recited in claim 3 wherein the first belt and the second belt each have a toothed side interacting the first pulley and second pulley, respectively.

6. The rotary blade device as recited in claim 2 wherein the second blade is spaced 180 degrees from the first blade.

7. The rotary blade device as recited in claim 1 wherein the first belt has a toothed side interacting with the first pulley and fixed pulley, the first pulley and the fixed pulley also being toothed.

8. The rotary blade device as recited in claim 1 further comprising a tension adjustment roller supported on the rotating arm between the first pulley and fixed pulley and contacting the first belt.

9. The rotary blade device as recited in claim 8 wherein the rotating arm has a slot, the tension adjustment roller being slidable in the slot.

10. The rotary blade device as recited in claim 1 wherein the first blade has a paper contacting edge and a cutout on the paper contacting edge.

11. The rotary blade device as recited in claim 1 wherein the first blade is located on a first side of the rotating blade and the first pulley, fixed pulley and first belt are located on another side of the rotating blade.

12. A rotary blade device for interacting with printed materials comprising:

a drive shaft;

a rotating arm driven by the drive shaft, a first pulley rotatably supported on the rotating arm, a first blade fixed to the first pulley and arranged vertically to support a sheet of printed material, a fixed pulley located coaxially with the drive shaft, and a first belt connecting the first pulley to the fixed pulley so that as the arm rotates, the first pulley rotates with respect to the arm, wherein the first blade remains vertically oriented during rotation of the arm and the first pulley.

13. The rotary blade device as recited in claim 12 wherein the drive shaft passes through the fixed pulley.

14. The rotary blade device as recited in claim 12 wherein the first blade has a paper contacting edge and a cutout on the paper contacting edge.

15. The rotary blade device as recited in claim 12 further comprising a second blade and a second pulley rotatably supported on the rotating arm.

16. The rotary blade device as recited in claim 15 further comprising a second belt and wherein the second pulley is connected to the fixed pulley via the second belt.

17. The rotary blade device as recited in claim 16 wherein the fixed pulley includes a first section and a second section coaxial with the first section, the first section contacting the first belt and the second section contacting the second belt.

18. The rotary blade device as recited in claim 16 wherein the first belt and the second belt each have a toothed side interacting the first pulley and second pulley, respectively.

19. The rotary blade device as recited in claim 15 wherein the second blade is spaced 180 degrees from the first blade.

* * * * *